United States Patent [19]

Sharpless

[11] Patent Number: 4,543,909

[45] Date of Patent: Oct. 1, 1985

[54] EXTERIORLY MOUNTED AND POSITIONABLE SPRAY COATING NOZZLE ASSEMBLY

[75] Inventor: John Sharpless, Oberlin, Ohio

[73] Assignee: Nordson Corporation, Amherst, Ohio

[21] Appl. No.: 616,124

[22] Filed: Jun. 1, 1984

[51] Int. Cl.[4] ..... B05B 15/06

[52] U.S. Cl. ..... 118/326; 239/587; 239/588

[58] Field of Search ..... 118/326; 239/587, 588

[56] References Cited

U.S. PATENT DOCUMENTS

| | | | |
|---|---|---|---|
| 3,027,869 | 4/1962 | Ball | 118/326 X |
| 3,434,416 | 3/1969 | Testone | 118/326 X |
| 4,002,143 | 1/1977 | Dover | 118/326 X |
| 4,173,198 | 11/1979 | Allen | 118/326 X |

FOREIGN PATENT DOCUMENTS

| | | | |
|---|---|---|---|
| 1033133 | 9/1953 | Fed. Rep. of Germany | 118/326 |

*Primary Examiner*—Shrive P. Beck

*Attorney, Agent, or Firm*—Wood, Herron & Evans

[57] ABSTRACT

An exteriorly mounted and positionable spray coating nozzle assembly for a spray coating system wherein a series of workpieces to be coated, such as bottles, are conveyed into a spray cabinet, along a path through a spray chamber, and past a bank of spray nozzles which apply a coating to the workpieces. A nozzle assembly support which is pivotally mounted to the outside of the spray cabinet permits the entire assembly to be swung to laterally position the nozzles relative to the length of the workpieces. The nozzles in turn are carried on a pivotal nozzle block which further permits the nozzles to be turned to adjust the aim of the nozzles with respect to the workpieces. The two pivotal movements provide for accurate aiming of the nozzles with greater lateral adjustability of the nozzles for spraying different length workpieces. The nozzle assembly further provides for the nozzles to be readily moved into and out of the spray chamber through a chamber port and toward and away from the path of the workpieces being conveyed past the nozzles to adjust the workpiece to nozzle distance. The nozzles can also be completely withdrawn from the chamber permitting ready access to them for maintenance, such as for unclogging of a spray nozzle.

10 Claims, 6 Drawing Figures

EXTERIORLY MOUNTED AND POSITIONABLE SPRAY COATING NOZZLE ASSEMBLY

FIELD OF THE INVENTION

This invention generally relates to spray coating systems where workpieces to be coated, such as bottles, are conveyed through a spray chamber past one or more spray nozzles which apply a coating to the workpieces and, more particularly, to an exteriorly mounted and positionable nozzle assembly for an impact spray coating system having two pivot mechanisms for accurate and adjustable positioning and aiming of the spray nozzles from outside of the spray chamber, with the nozzles being readily movable in and out of the spray chamber to locate them with respect to the workpieces and for ease of access to the nozzles for maintenance.

BACKGROUND OF THE INVENTION

Spray coating systems are well known in the art. Such systems ordinarily include a conveyor carrying a series of articles to be coated along a path which, in part, passes through the spray chamber of a spray cabinet or booth. Located in the spray chamber are spray nozzles which spray a coating on each of the articles as they pass by.

There has recently been developed by the assignee of this invention a process for providing a substrate such as polyethylene terephthalate (PET) bottles with a gas barrier coating of a copolymer of vinylidene chloride. This barrier coating prolongs the shelf life of product contained in the bottle by retarding carbon dioxide migration through the walls of the bottle, oxygen penetration into the bottle, and water migration and penetration. For example, the process is particularly applicable to provide PET bottles with a barrier coating to prevent the loss of carbonation of beverages contained therein.

The process involves locating each container to be coated in close proximity to one or more airless spray nozzles, and impacting the outside surface of the container with a stream of stabilized aqueous polymer dispersion, such as an aqueous polyvinylidene dispersion, to obtain a uniform coating on the surface of the container. It has been found that the impacting force of the spray on the container quite unexpectedly leads to barrier coatings which exceed known properties heretofore achieved by the industry. It has been found critical to obtaining a uniform film of polymer having superior adhesive and barrier properties that the spray coating reach the substrate surface with a force sufficient to cause phase inversion on the surface and not before. This requires positioning of the spray nozzles in close proximity to the bottles to be coated such that the outside surface of the container is impacted with the stream of coating material. It is also important that the spray coating impact the surface of the bottle over its entire surface to provide a uniform, continuous barrier coating.

SUMMARY OF THE INVENTION

A primary object of this invention is to provide a spray nozzle assembly for impact spraying of workpieces such as PET bottles, wherein the nozzle is readily positionable at a desired distance from the bottle surface being sprayed, with the distance position being easily adjusted from outside of the spray cabinet to enable impact spraying of various diameter bottles.

Another object of this invention is to provide a spray nozzle assembly for an impact spray coating system wherein the nozzles have a wide range of lateral adjustability for aiming the nozzles at elongated workpieces, such as bottles.

A further object of this invention is to provide a spray nozzle assembly which is positionable from outside of the spray coater and which can be removed from the coater for maintenance without the need for shutting down the coating operation and entering the spray coater.

In its general aspect, these objectives have been accomplished in accordance with a presently preferred form of this invention by providing an exteriorly mounted and positionably spray coating nozzle assembly which can be slid in and out of a spray chamber through a port in the chamber wall for adjustably positioning the nozzle relative to the bottles being sprayed for proper nozzle to bottle spacing. Two pivot movements for laterally positioning and accurately aiming one or more nozzles for a desired direction of fluid spray from the nozzles are provided.

The nozzle assembly includes at least one nozzle through which fluid under pressure is sprayed, and a fluid line conveying fluid under pressure to the nozzle. The nozzle assembly is mounted on a shaft which is journaled for axial movement in a pair of spaced bearing blocks which are secured to an assembly support arm exteriorly of the spray coater. The nozzle assembly is moveable to position the nozzles a desired distance from the bottles in the spray chamber by sliding the shaft axially toward or away from the bottles to the proper distance for impact spraying. Stops are provided along the sliding shaft to limit the movement of the shaft, and thus the nozzle, in either direction, with the stops made adjustable for a selected distance of travel. The nozzle assembly can also be completely withdrawn from the spray chamber so as to access the nozzle for maintenance.

Where elongated workpieces, such as bottles, are to be coated by impact spraying, it is proposed to use a plurality of nozzle assemblies arranged side-by-side in a bank located along one side of the conveyor path. Each of the nozzle assemblies is aimed at a different portion of the bottle, i.e. neck, middle, and end, with overlapping spray patterns used to completely coat the bottle. More than one nozzle assembly is used to better direct the spray and to increase bottle throughput. The bottles are carried on spindles which are rotated to turn the bottles as they pass by the bank of nozzles.

An additional bank of nozzle assemblies can also be provided in the spray chamber. In the event that a malfunction occurs in a spray nozzle of an operating bank, as by clogging of a spray nozzle, the entire bank can be shut down and the other bank started up to continue the coating operation while the first bank is attended to. As stated, the nozzles are removeable from the chamber to be worked on from outside of the chamber making access to the nozzles for maintenance particularly easy.

The mounted spray nozzles used in the bank are also provided with a sufficient range of adjustability to permit spraying of different length bottles. For instance, the spray patterns from the nozzles might be made more overlapping for spraying a shorter bottle, and less overlapping for spraying a longer bottle. Lateral adjustability of the spray nozzles for flexibility in aiming the spray nozzles is provided by a nozzle assembly support in the form of a swinging arm which is pivotally mounted to the exterior of the spray chamber, which permits the entire assembly to be pivoted in an arc for laterally positioning the nozzles relative to the longitudinal axis of the bottles. In a present embodiment of the invention, with the path of the bottles to be coated being vertical in the vicinity of the spray nozzles and the bottles mounted to extend horizontally, the nozzle assembly support pivots the entire nozzle assembly in a horizontal plane to laterally position, and initially aim, the spray nozzles.

A second nozzle aiming adjustment is provided by a pivoting nozzle mount which permits just the nozzle and nozzle mount to be pivoted, also in a horizontal plane, to precisely aim the nozzles at the bottle region to be sprayed after the first adjustment has laterally oriented the nozzles. In a presently preferred form of the invention, pivotal movement of the nozzle mount is accomplished by axial movement of a control rod connected to one side of a nozzle mount block. The rod is threaded, and received in a mounted thumbwheel, which when turned, causes the rod to move axially thereby rotating the nozzle block about its pivot.

In use, the entire nozzle assembly is initially provided on the support arm to a first adjustment position which laterally orients the nozzles relative to the bottle axes. The nozzles are then pivoted on the nozzle mount for a second adjustment to precisely aim the nozzles at the region of the bottles to be sprayed. A high degree of adjustability for more accurate nozzle aiming is thus achieved by this combined pivotal motion.

It is to be noted that the nozzle aiming mechanisms are located exterior to the spray chamber. This allows the aiming mechanisms to be readily used by an operator, and further protects the mechanisms from fluid spray in the chamber which would foul them. In this same regard, the rest of the nozzle assembly is likewise protected from the fluid spray which might damage or foul the assembly.

DETAILED DESCRIPTION OF THE INVENTION

General Operation

Figure 1:
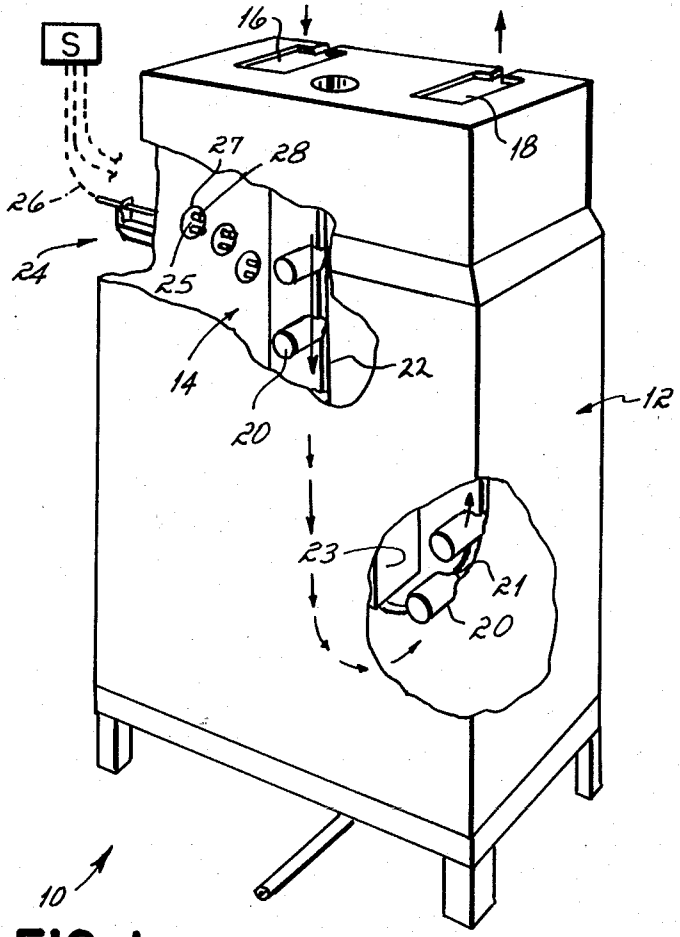
FIG. 1 is a pictorial view with parts broken away of a spray cabinet of a coating system having spray nozzle assemblies made in accordance with this invention.

FIG. 1 shows in schematic form a spray coating booth 10 which is part of a spray coating system. The booth 10 has a housing or cabinet 12 within which is a spray chamber 14. The chamber 14 is substantially enclosed by the cabinet 12, and has an inlet 16 through which workpieces pass into the chamber and an outlet 18 through which coated workpieces exit. In this embodiment of the invention, the workpieces are shown as bottles 20 which are carried on spindles 21 forming part of a bottle conveyor (not shown). The bottle conveyor is located outside the booth 10, and the spindles 21 pass through a slot 22 in the chamber side wall permitting a series of bottles mounted on spindles 21 to be conveyed through the inlet 16, into the cabinet spray chamber 14, through a vertical loop within the cabinet (shown by arrows) and out the outlet 18. A vertical panel 23 in the chamber separates the cabinet into a bottle spraying side (left-hand portion in FIG. 1) and a side protected from any overspray for removing the coated bottles from the cabinet (right-hand portion of FIG. 1). It should be noted that the invention is not limited to vertically conveyed bottles, however, but is readily adaptable to a system wherein the bottles are conveyed in a horizontal plane for spraying.

A bank of spray nozzle assemblies 24 is arranged on one side of the conveyor path where the bottles 20 are conveyed into the spray chamber 14. Each of the nozzle assemblies 24 has a spray nozzle mount portion 24 which extends into the spray chamber 14 through a port 27 formed in a sidewall of cabinet 12. A bank of three nozzle assemblies 24 is shown in FIG. 1, with the nozzle mount portions 25 staggered in a diagonal line to permit the assemblies 24 to pivot side to side without interfering with one another. This pivotal movement will be described in more detail hereinafter. A plurality of nozzle assemblies 24 is used to better direct spray at the elongated bottles, such as for the impact spraying process previously described, as well as to increase the throughput of fluid being sprayed, which in turn permits bottles 20 to be conveyed through the system more quickly. Each of the assemblies has a pair of vertically spaced airless spray nozzles 28, such as 6/12 spray nozzles, Part No. 701244 manufactured by Nordson Corp. of Amherst, Ohio. Two nozzles are used in this embodiment to increase spray throughput.

Each nozzle mount portion 25 has its nozzles 28 aimed at a particular sector of the passing bottles i.e. one portion is aimed at a respective upper, middle, or lower portion of a bottle 20. The spray patterns from the three spray assemblies 24 are arranged to overlap so as to completely coat the sides of the bottles. The spindles are rotated on the conveyor to turn the bottles 20 as they pass by the bank of nozzle assemblies 24 to expose all sides of the bottle to spray. Pressurized fluid to be sprayed on the bottles 20 is supplied from a source S which pumps the fluid through a feedline 26 connected to each of the nozzle assemblies 24.

A like bank of spray nozzle assemblies 24 (not shown) is located vertically below the illustrated bank. This second bank of nozzle assemblies is used in the event that the first bank has to be shut down, such as for maintenance of one of the spray nozzle 24. The ability to switch from one bank to another allows the coating of the bottles to continue without significant interruption.

When the spray coating system is in operation, bottles 20 are placed on the spindles 21 of the conveyor at a loading station. From there, the bottles are conveyed to the coating booth and through the inlet 16 into the spray chamber 14. The bottles 20 pass vertically downwardly along one side of the chamber 14 and past the bank of nozzle assemblies 24, which spray a coating on the bottles as they pass by. The bottles 20 then pass around a loop at the bottom of the spray chamber 14, and then vertically upwardly and out of the chamber and booth through outlet 18. The panel 23 separates the vertically descending line of bottles to be coated from the vertically ascending line of coated bottles. The bottles 20 are then conveyed to a drying area or oven where the coating is set, and then to a discharge station where the finished bottles are removed from the conveyor.

Detailed Description of the Spray Nozzle Assembly

Figure 2:
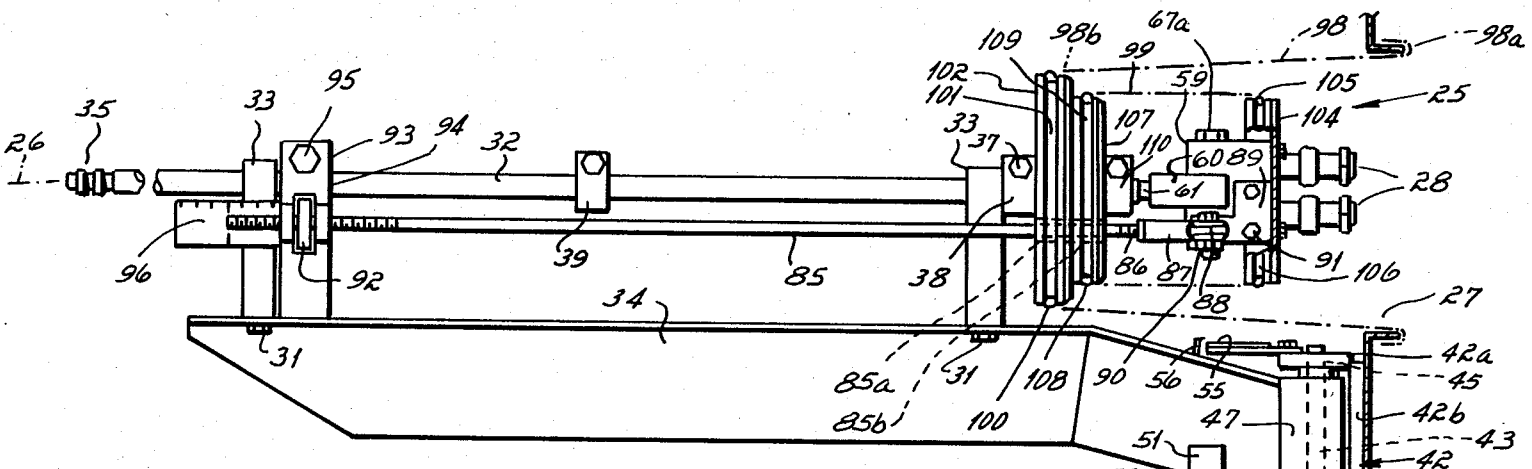
FIG. 2 is a side elevational view of a spray nozzle assembly of this invention.
Figure 3:
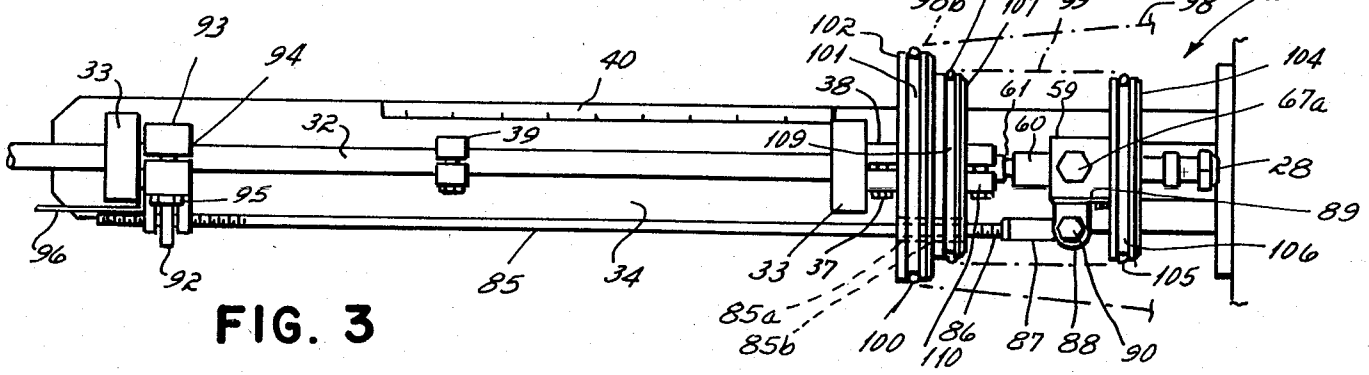
FIG. 3 is a top plan view of the spray nozzle assembly of FIG. 2.

Referring now to FIGS. 2 and 3, each of the nozzle mount portions 25 is carried on one end of a shaft 32. The shaft 32 is journaled in a pair of spaced bearing blocks 33 and is axially slidable. The bearing blocks 33 are mounted to the upper surface of a swingable support arm 34 by screws 31, which arm is in turn pivotally mounted to the exterior of a sidewall of the spray cabinet on a support arm pivot mount 36. Both the manner of connection of the nozzles 28 on the shaft 32 and the pivotal connection of the support arm 34 to the cabinet 12 will be described in more detail hereinafter.

The shaft 32 is a stainless steel pipe which has a hose fitting 35 at one end for connection to the pressurized fluid feedline 26. A split collar inboard stop 38 is releasably fixed about the shaft 32 through the use of a tightening screw 37. The stop 38 limits the outward movement (away from the port 27 in the cabinet sidewall) of the shaft 32, and the nozzle mount portion 25, which is carried thereon. A like stop 39 is provided more outboard along the shaft 32, and serves as a limiter to the inward movement of the shaft 32, that is, the movement of the nozzle mount portion 25 into the spray chamber 14 through port 27.

A scale 40 (FIG. 3) is provided on the upper surface of the support arm 34 for use in association with the outboard stop 39 to set the distance of travel for the shaft 32. This is desirable when setting up the nozzle assembly 24 for spraying at a previously determined nozzle to bottle distance.

Movement of the nozzles 28 in and out of the chamber 14 is thus simply accomplished by manually sliding the shaft 32 in the desired direction. More significantly, the bottle to nozzle distance can be readily adjusted for the impact spray process previously described and adjusted for spraying bottles of different diameters. Different diameter bottles will of course require the nozzles to be moved to maintain the same spacing distance from bottle to nozzle. This mechanism for sliding the nozzles toward and away from the bottles thus provides ready adjustability from outside of the chamber for the proper spacing. Furthermore, each of the nozzle mount portions 25 can be completely withdrawn from the spray chamber 14 in the event maintenance is required, such as to unclog a nozzle 28 which has become fouled from spray buildup. Maintenance of an individual assembly can thus be quickly effected, and without disturbance of any of the other assembles 24 in the bank.

Two cooperating pivotal movements are provided for each nozzle assembly which permit very accurate and adjustable aiming of the spray nozzles 28.

A first pivotal movement for positioning the entire assembly 24 is provided by the support arm 34 and support arm pivot mount 36. The pivot mount comprises a U-shaped mounting bracket 42 which has a back plate **42*b* which is fixed to the exterior of the cabinet 12 by screws or bolts (not shown). A fixed pivot pin 43 is carried by the bracket 42, extending through a bore 44 in lower bracket portion 42*c*, and a bore 45 formed in the upper bracket portion 42*a*. The pivot pin 43 extends through a throughbore 46 in an end block 47 which forms part of support arm 34. This permits the entire support arm 34 to be pivoted in an arc about the vertical conveyor path, that is, in a horizontal plane which is essentially perpendicular to the path of the horizontal bottles being conveyed past the nozzle assembly 24. The entire assembly can thus be swung to a first adjustment position to laterally orient the nozzles relative to the bottles. This first adjustment using the support arm pivot enables lateral or side-to-side position adjustment of the nozzles 28 relative to the bottles 20. That is, the position of the support arm 34** establishes the position of the nozzles along the longitudinal axis of the bottles, i.e., aimed more toward the neck or more toward the bottom of the bottle.

The support arm is locked in this initial position by a lock mechanism 50. The support arm lock mechanism 50 includes a mounting block 51 which depends from the support arm 34. The mounting block 51 has a threaded bore 52 which receives a threaded stem 53 carried on a knob 54. The stem 53 extends through an arcuate slot (not shown) in the bottom portion **42*c* of the support arm mounting bracket. Rotation of the knob 54 to engage the lower surface of the bottom bracket portion 42*c* thus frictionally locks the support arm 34 against further movement. Counterrotation releases the support arm 34. A scale 55 is fixed to the upper bracket portion 42*a*, which, with a reference pin 56 on arm 34**, allows positioning of the support arm to a previously determined setting.

A second pivot mechanism for aiming the spray nozzles 28 is provided by making the mount portion 25 independently pivotable. The nozzle mount portion 25 includes a nozzle block 59 which pivots on a rod end 60 received on a nipple 61 extending from the inboard end of the slide shaft 32.

Figure 4:
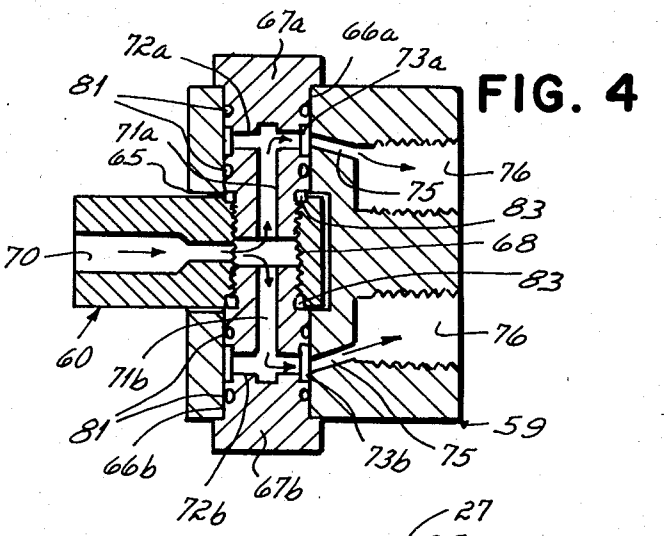
FIG. 4 is a cross-sectional view of the nozzle pivot mechanism.

With particular reference to FIGS. 2 and 4, the nozzle block 59 has a lateral channel or slot 65 across the back of the block which extends partway through the nozzle block. The inboard end of rod end 60 is received in this slot 65. A lateral slot 65 is used to permit side to side movement of the nozzle block on the rod end 60. Opposed upper and lower radial bores **66*a* and 66*b*, respectively, are formed in the top and bottom of the nozzle block 59, and extend into the slot 65. Upper and lower pivot stems 67*a* and 67*b*, respectively, are received in the upper and lower radial bores 66*a* and 66*b*. The ends of the pivot stems extend into an internally threaded radial bore 68 through the rod end 60. The pivot stems 67*a* and 67*b* are threaded into bore 68, and form the pivot for the nozzle block 59 on the rod end 60**.

The nozzle mount portion 25 further provides for the continuous passage of pressurized fluid through the nozzles regardless of the pivoted position of the nozzles. Pressurized fluid flowing axially through the slide shaft 32 passes to the rod end 60 via axial channel 70, which extends partway through the rod end 60. The fluid then passes into bore 68 in the rod end 60 between the inner ends of the pivot stems **67*a* and 67*b*, and then through axially extending passages 71*a* and 71*b* formed in the respective pivot stems 67*a* and 67*b*. From there, the fluid passes to ports 72*a* and 72*b* formed in the respective pivot stems which direct the fluid to annular recesses 73*a* and 73*b* on the respective pivot stems. These annular recesses 73*a* and 73*b* form channels with the nozzle block 59 which communicate with fluid passages 75 formed in the nozzle block 59. The fluid passages 75 in turn communicate with nozzle bores 76, in which the nozzles 28 are threaded. This fluid flow path is indicated by arrows in FIG. 4**.

As can be seen, the nozzle block passages 75 will always be in communication with the channels formed by the annular recesses 73*a* and 73*b* to thus provide continuous fluid flow to the nozzles 28 regardless of how the nozzle block 59 may be pivoted about the stems 67.

O-ring seals 81 are received in circumferential recesses formed on the pivot stems above and below the annular recesses 73*a* and 73*b*. O-ring seals 83 are additionally provided around the stems 67*a* and 67*b* in the area of the rod end bore 68. These seals prevent leakage of the coating fluid while permitting pivoting of the nozzle block.

Referring again to FIGS. 2 and 3, the nozzle mount portion 25 is pivoted by an axially movable control rod 85. The rod 85 has a rod end portion 86 provided with a bearing eye 87. The bearing eye 87 is pivotally secured by a nut and bolt combination 90 to an ear 88 of a bracket 89 which is fixed to the side of swivel block 59 by screws 91. The other end of the control rod 85 is threaded and is received in and extends through a thumbwheel 92 which is rotatably carried on a thumbwheel mounting block 93.

The thumbwheel mounting block 93 is split at one end in the vicinity of a throughbore 94 through which the sliding shaft 32 extends. The block 93 is secured to the sliding shaft 32 by tightening of the screw 95, which draws the split portions of the block 93 together to engage the shaft and fix the block in place. Both the mounting block 93 and the control rod 85 consequently move with the shaft 32.

Pivoting adjustment of the nozzle mount portion 25 to form a second adjustment for aiming the nozzles 28 is accomplished by rotating the thumbwheel 92. This draws the threaded control rod 85 through the thumbwheel, moving the rod axially forwardly or rearwardly, depending on the wheel rotation. The rod movement in turn causes the nozzle block 59 to turn about the pivot (67*a*, 67*b*) to thereby adjust the nozzle aim. A scale 96 fixed to the mounting block 93 is provided for setting the nozzle angle to a previously determined position.

Figure 5A:
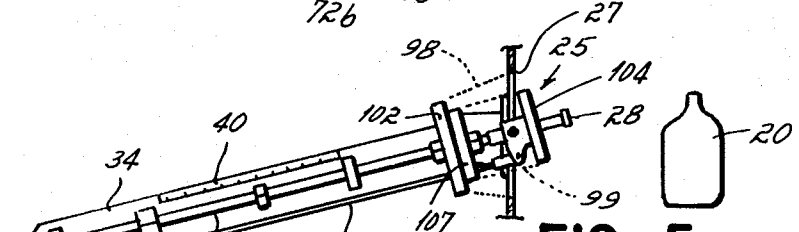
FIGS. 5*a* and 5*b* are schematic illustrations showing in plan view a typical nozzle adjustment sequence, wherein the spray nozzle assembly support is first pivoted (5*a*), and then the nozzle mount is pivoted to aim the spray nozzles (5*b*).
Figure 5B:
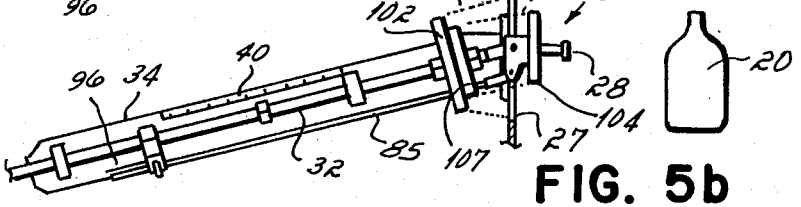

A typical nozzle aiming sequence is schematically illustrated in FIGS. 5*a* and 5*b*. A first adjustment is made by swinging the support arm 34 about its pivot mount 36. This establishes the lateral position of the nozzles 28 relative to the axis of the bottle 20, here generally locating the spray nozzles 28 of the assembly 24 at the upper sector of the bottle 20 in the vicinity of the bottle neck (FIG. 5*a*). A second adjustment for aiming the nozzles 28 directly at the bottle sector to be sprayed is then made by turning of the thumbwheel 92 to rotate the nozzle block 59 about its pivot 67*a*, 67*b* to the desired position aim (FIG. 5*b*).

This invention has the further advantage of locating the two pivot mechanisms where they can be manipulated exteriorly of the spray chamber 14. That is, the support arm pivot mount 36 and thumbwheel control 92 are both located outside of the chamber 14, where they can be readily manipulated to adjust the nozzle aim.

A pair of flexible sleeves 98 and 99 are provided to seal the port 27 against the escape of sprayed fluid, and to protect the moving parts of the spray nozzle assembly 24 from such spray. This is particularly important when spraying aqueous vinylidene chloride as a barrier coating material since, when the water evaporates, the vinylidene chloride tends to stick to parts and can gum or foul moving parts.

A first flexible sleeve 98 made of a clear plastic film or the like is fixed at one end 98*a* around the perimeter of the port 27. The other end 98*b* of the first sleeve 98 is sealed about the nozzle assembly 24 by an O-ring 100 which is received in a circumferential annular slot 101 formed in a disk-shaped sleeve mount 102. The sleeve mount 102 has an axially bore (not shown) through which the sliding shaft 32 extends, the mount 102 being carried by the shaft 32.

The first sleeve 98 thus prevents sprayed fluid from escaping out of the port 27. Since the sleeve is flexible, movement of the nozzles 28 into the chamber 14 simply causes the sleeve to turn inside out, with the seal between port and the nozzle assembly 24 being retained.

A second flexible sleeve 99 is provided to protect the nozzle mount portion 25 from sprayed fluid. The second sleeve 99 is also made from a flexible plastic film or the like, and is sealed at one end to a disk-shaped sleeve mount 104 by an O-ring 105 received in an annular circumferential channel 106 formed in the sleeve mount 104. Sleeve mount 104 is fixed about the inboard end of the nozzle block 59. Another sleeve mount 107 is outboard to the nozzle mount portion 25, and has an O-ring 108 which holds the other end of the second sleeve 99 in a circumferential annular groove 109 in mount 107. Sleeve mount 107 abuts mount 102 in this embodiment, and like mount 102, has an axial bore (not shown) through which the slide shaft 32 extends. Both of the sleeve mounts 102 and 107 are captured between shaft stop 38 and another stop 110. Stop 110 is carried on the shaft 32 solely for this purpose. Control rod 85 extends through throughbores 85*a* and 85*b* formed in sleeve mounts 102 and 107, respectively.

Sleeve 99 protects the nozzle mount 58 from fluid spray which might otherwise foul the nozzle pivot mechanism. Use of O-rings securing both the sleeves 98 and 99 in place further facilitates ready removal of the sleeves from the sleeve mounts, which permits easy access to the nozzles and nozzle pivot mechanism for maintenance.

Thus, while the invention has been described in connection with a certain presently preferred embodiment, those skilled in the art will recognize modifications of structure, arrangement, portions, elements, materials, and components which can be used in the practice of the invention without departing from the principles of this invention. In particular, although the invention has been described in terms of its applicability to impact spray coating, it is not limited to such a process but is applicable to a variety of spray coating processes. Further, although the assemblies have been described in terms of a pair of nozzles, it will be understood that one or more nozzles per assembly can be used, as desired.

What is claimed is:

1. A spray nozzle assembly for spray coating workpieces in a cabinet with a coating material, comprising:

a spray nozzle through which the coating material is sprayed;

nozzle support means for supporting said spray nozzle, said nozzle support means adapted to be mounted exteriorly of the cabinet and being movable relative to the cabinet to position said spray nozzle with respect to workpiece; and nozzle positioning means mounted to said nozzle support means for positioning said spray nozzle relative to said nozzle support means, said nozzle positioning means being operable to position said spray nozzle with respect to a workpiece independently of said nozzle support means.

2. The spray nozzle assembly of claim 1 wherein said nozzle support means is pivotal to swing said nozzle through an arc to position said nozzle with respect to the workpieces to be coated.

3. The spray nozzle assembly of claim 1 wherein said nozzle positioning means includes means for moving said spray nozzle into and out of said cabinet through an opening in the wall of the cabinet.

4. The spray nozzle assembly of claim 3 wherein said means for mounting said nozzle permitting said nozzle to be moved in and out of the cabinet comprises a pair of bearing blocks attached to a spray nozzle support, a tube for conveying coating material supported by said bearing blocks and slidable therein, said tube having a first open end adapted to be connected to a source of coating material and a second open end, and a nozzle block mounted to said second open end of said tube and in fluid communication therewith for conveying coating material from said tube to said nozzle, said nozzle being movable in and out of said cabinet through the opening in the wall of the cabinet by sliding said tube in said bearing blocks to thereby position said nozzle a predetermined distance from the surface of a workpiece to be coated.

5. The spray nozzle assembly of claim 1 wherein said nozzle positioning means further includes means for mounting said nozzle for movement independent of the means for moving said spray nozzle into and out of the cabinet and being manipulatable from outside the cabinet whereby said nozzle assembly has at least two degrees of freedom for positioning and aiming said nozzle from outside of said cabinet.

6. The spray nozzle assembly of claim 5 wherein said means for mounting said nozzle for movement independent of the movement of said means for moving said spray nozzle in and out of the cabinet comprises a nozzle block carrying said nozzle which pivots for aiming of said nozzle at the workpieces without interrupting the flow of coating material to said nozzle, and an elongated rod pivotally connected at one end to said nozzle block, the other end of said rod being manipulatable from outside the cabinet to pivot said nozzle block.

7. The spray nozzle assembly of claim 6 wherein said elongated rod pivotally connected at one end to said nozzle block is laterally offset from the pivotal axis of said nozzle block and the other end of said rod is threaded and received in a thumbwheel carried in a thumbwheel mount exteriorly to the cabinet, rotation of said thumbwheel causing said rod to move axially to thereby pivot said nozzle block.

8. A spray nozzle assembly for spray coating of workpieces in a cabinet, comprising a spray nozzle through which a coating material is sprayed, a nozzle support adapted to be mounted externally of the cabinet, said support being movable to position said spray nozzle with respect to the workpieces to be coated, means for mounting said spray nozzle to said nozzle support for permitting said nozzle to be moved relative to said nozzle support in and out of the cabinet through an opening in the wall of the cabinet, and means for mounting said nozzle for movement independent of the movement of said nozzle support and of the in and out movement of said spray nozzle, said nozzle mounting means being manipulatable from the outside of the cabinet, said nozzle assembly thereby having three degrees of freedom for positioning and aiming said nozzle from outside of the cabinet for coating of the workpieces.

9. A spray nozzle assembly for spray coating of workpieces in a cabinet where workpieces are conveyed along a path past at least one spray nozzle to be spray coated with a fluid coating material, comprising a spray nozzle through which a coating material is sprayed, a spray nozzle support adapted to be mounted exteriorly of the cabinet, said spray nozzle support being pivotal to swing said spray nozzle through an arc to position said spray nozzle with respect to the workpieces to be coated, a pair of bearing blocks attached to said spray nozzle support, a tube for conveying coating material, said tube being supported by said bearing blocks and being slidable therein, said tube having a first open end adapted to be connected to a source of coating material and a second open end, a nozzle block mounted to said second open end of said tube in fluid flow communication therewith for conveying coating material from said tube to said nozzle, said nozzle block being pivotal on an axis generally perpendicular to the long axis of said tube without interrupting the flow of coating material from said tube to said nozzle, said spray nozzle being movable along an axis generally perpendicular to the spray nozzle support pivot axis in and out of said cabinet through an opening in the wall of the cabinet by sliding said tube in said bearing blocks to thereby position said nozzle a predetermined distance from the surface of the workpiece to be coated, means for pivoting said nozzle block from outside of said cabinet to aim said nozzle at the workpiece to be coated, and flexible sleeve means adapted to be attached at one end to the cabinet about the periphery of the opening in the cabinet wall and at the other end to a mount movable with said nozzle for sealing the cabinet from escape of coating material while permitting the swinging movement of said spray nozzle support and the in and out movement of the nozzle.

10. Apparatus for spray coating workpieces with a coating material, comprising:

a cabinet having an open interior adapted to receive the workpieces therein;

a spray nozzle through which the coating material is sprayed;

nozzle support means for supporting said spray nozzle, said nozzle support means being mounted exteriorly of said cabinet and being movable relative to said cabinet to position said spray nozzle with respect to the workpieces; and nozzle positioning means mounted to said nozzle support means for positioning said spray nozzle relative to said nozzle support means, said nozzle positioning means being operable to position said spray nozzle with respect to the workpieces independently of said nozzle support means.

* * * * *